US011703295B2

(12) United States Patent
Harel et al.

(10) Patent No.: US 11,703,295 B2
(45) Date of Patent: Jul. 18, 2023

(54) HANDGUN SAFE DISMANTLING MECHANISM

(71) Applicant: ISRAEL WEAPON INDUSTRIES (I.W.I.) LTD., Ramat HaSharon (IL)

(72) Inventors: Yosef Harel, Bnei Dekalim (IL); Niv Ronen, Yahud (IL); Amir Zonshine, Yavne (IL)

(73) Assignee: ISRAEL WEAPON INDUSTRIES (I.W.I) LTD., Ramat Hasharon (IL)

( * ) Notice: Subject to any disclaimer, the term of this patent is extended or adjusted under 35 U.S.C. 154(b) by 332 days.

(21) Appl. No.: 17/137,443

(22) Filed: Dec. 30, 2020

(65) Prior Publication Data

US 2021/0207913 A1 Jul. 8, 2021

(30) Foreign Application Priority Data

Jan. 7, 2020 (IL) ..... 271880

(51) Int. Cl.

| | |
|---|---|
| ***F41A 17/30*** | (2006.01) |
| ***F41A 17/56*** | (2006.01) |
| ***F41A 17/34*** | (2006.01) |
| ***F41A 11/00*** | (2006.01) |

(52) U.S. Cl.

CPC ..... *F41A 17/30* (2013.01); *F41A 17/34* (2013.01); *F41A 17/56* (2013.01); *F41A 11/00* (2013.01)

(58) Field of Classification Search

CPC ..... F41A 17/30; F41A 17/34; F41A 17/56; F41A 17/62; F41A 11/00; F41A 17/00–82

See application file for complete search history.

(56) References Cited

U.S. PATENT DOCUMENTS

| | | | | |
|---|---|---|---|---|
| 3,745,881 | A * | 7/1973 | Roy | F41A 3/64 89/196 |
| 7,810,269 | B2 | 10/2010 | Zukowski et al. | |
| 8,033,043 | B2 | 10/2011 | McGarry | |
| 8,371,058 | B2 | 2/2013 | Trpcic | |
| 8,950,100 | B2 * | 2/2015 | Nebeker | F41A 11/00 42/108 |
| 9,303,936 | B2 | 4/2016 | Toner | |
| 10,119,777 | B2 | 11/2018 | Wolf et al. | |

(Continued)

FOREIGN PATENT DOCUMENTS

| | | | |
|---|---|---|---|
| DE | 102013022080 B3 * | 7/2014 | F41A 11/00 |
| EP | 2116804 A1 * | 11/2009 | F41A 11/00 |

*Primary Examiner* — Gabriel J. Klein

(74) *Attorney, Agent, or Firm* — Soroker Agmon Nordman

(57) ABSTRACT

A handgun, including a safety lever for disengaging a sear, the safety lever located under a slide of the handgun and extending along a longitudinal axis within a body of the handgun, wherein the safety lever includes a) a sear switch located external to the body of the handgun, and is configured to be positioned by a user in one of at least two positions along the longitudinal axis of the handgun and configured to move the safety lever with the sear switch to an elected position; (b) a sear tab at a rear end of the safety lever near a sear of the handgun, wherein when the sear switch is in a first position the sear tab does not interfere with the action of the sear and when in a second position the sear tab causes the sear to tilt so that the sear is disengaged and cannot come in contact with a striker of the handgun to fire a bullet.

16 Claims, 5 Drawing Sheets

(56) References Cited

U.S. PATENT DOCUMENTS

| | | | | |
|---|---|---|---|---|
| 10,731,935 | B1 * | 8/2020 | Sapio | F41A 3/66 |
| 2006/0249014 | A1 * | 11/2006 | Curry | F41A 11/00 89/196 |
| 2011/0126441 | A1 * | 6/2011 | Vukovic | F41A 17/72 29/428 |
| 2011/0162248 | A1 * | 7/2011 | Trpcic | F41A 17/64 42/108 |
| 2015/0323274 | A1 * | 11/2015 | Toner | F41A 17/56 42/70.01 |
| 2016/0146559 | A1 * | 5/2016 | Bantie | F41A 17/34 42/108 |
| 2016/0320155 | A1 * | 11/2016 | Singh | F41A 17/72 |
| 2017/0184358 | A1 | 6/2017 | Zajk | |
| 2017/0184365 | A1 | 6/2017 | Zajk | |
| 2017/0184366 | A1 * | 6/2017 | Zajk | F41A 21/00 |
| 2019/0195587 | A1 * | 6/2019 | Thomele | F41A 11/00 |

* cited by examiner

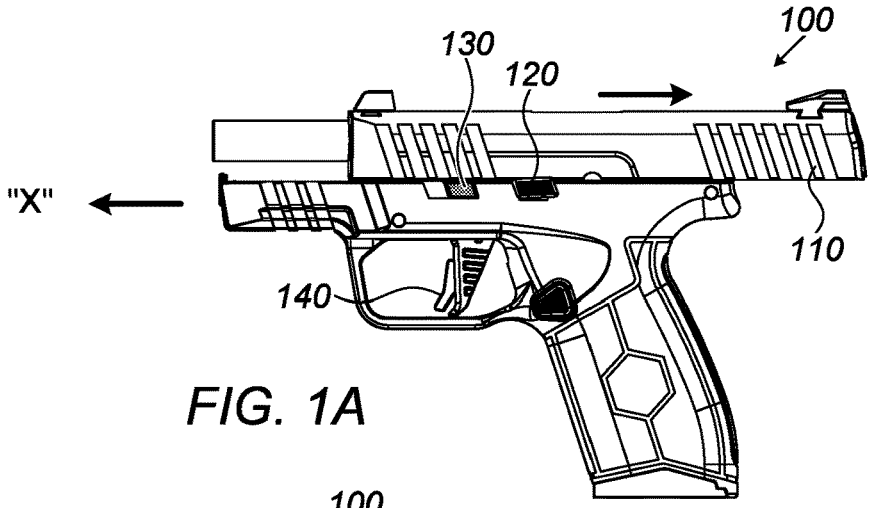
FIG. 1A
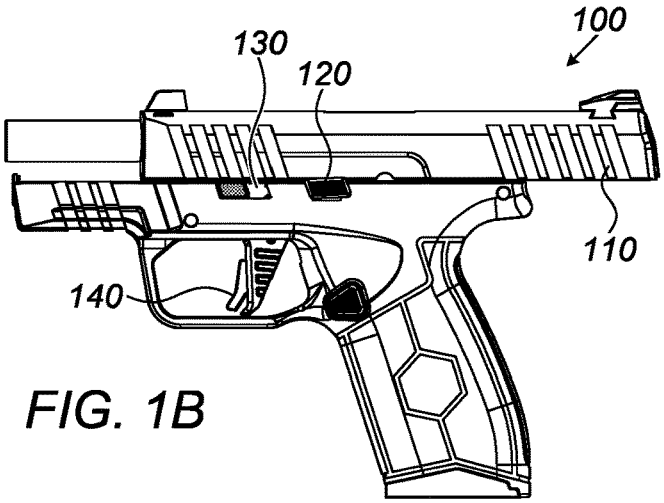
FIG. 1B
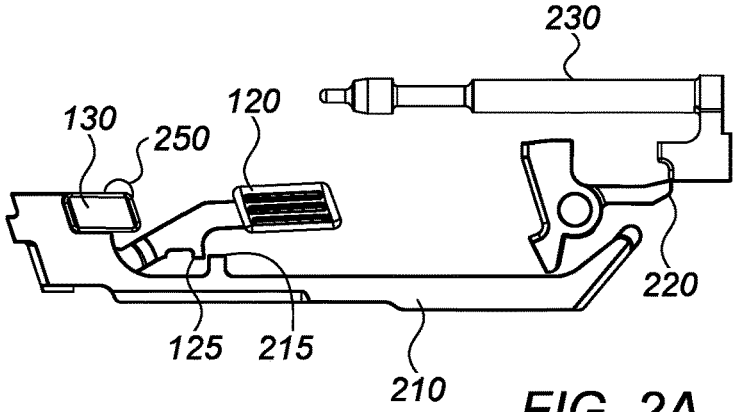
FIG. 2A
FIG. 2B
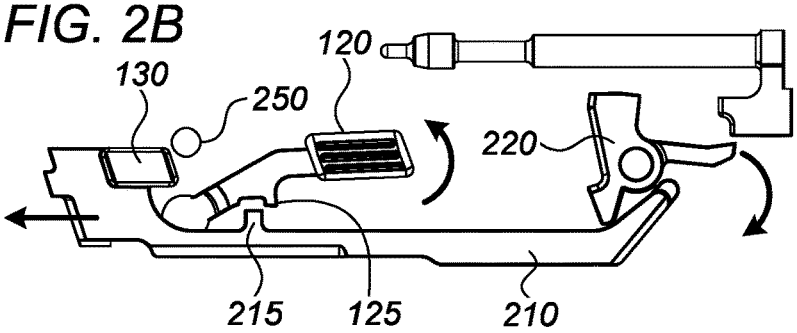

A-A

A-A

HANDGUN SAFE DISMANTLING MECHANISM

FIELD OF THE DISCLOSURE

The present disclosure relates generally to handguns that are fired by a striker and more specifically to a handgun with a mechanism to prevent firing when dismantling the handgun.

BACKGROUND OF THE DISCLOSURE

Many handguns include a spring loaded firing pin, which is referred to as a striker. The striker is cocked by pulling the slide mechanism toward the user. When the user pulls the trigger a sear releases the striker that fires a bullet.

When dismantling the handgun the striker must be separated from the sear in a way that prevents the striker from accidentally discharging the handgun. In some handguns the user must assure that the magazine is removed and the firing chamber is empty because the striker is separated from the sear by releasing the trigger. However if a bullet is loaded the striker will cause it to be fired.

Thus it would be desirable to be able to ensure that the handgun will not be fired when being dismantled. U.S. Pat. No. 9,222,745 to Kallio dated Dec. 29, 2015 and U.S. Pat. No. 9,303,936 to Toner dated Apr. 5, 2016 describes possible handgun assemblies that can be dismantled without releasing a bullet.

SUMMARY OF THE DISCLOSURE

An aspect of an embodiment of the disclosure, relates to a handgun with a safety lever under the slide within the body of the handgun. The safety lever extends along a longitudinal axis of the handgun between the sear and a sear switch. The sear switch is part of the safety lever or coupled to the safety lever so that it moves the safety lever when moved. The sear switch is initially in a first position when the handgun is functional. The safety lever includes a sear tab at the rear of the handgun near the sear. When the sear switch is moved to a second position the safety lever moves forward and the sear tab tilts the sear, causing it to be disengaged from a striker of the handgun, so that the handgun cannot fire a bullet.

In an exemplary embodiment of the disclosure, the safety lever includes a safety lever tab that is locked by elements of the handgun to prevent movement of the safety lever. Optionally, the handgun includes a slide stopper with a slide stopper tab that initially locks the safety lever tab so that the safety lever cannot move. In an exemplary embodiment of the disclosure, when moving the slide the slide stopper can be raised at specific positions to stop the slide and prevent it from returning to an initial position.

There is thus provided according to an exemplary embodiment of the disclosure, a handgun, comprising:

A safety lever for disengaging a sear, the safety lever located under a slide of the handgun and extending along a longitudinal axis within a body of the handgun;

Wherein the safety lever comprises:

(a) a sear switch located external to the body of the handgun, and is configured to be positioned by a user in one of at least two positions along the longitudinal axis of the handgun and configured to move the safety lever with the sear switch to an elected position;

(b) a sear tab at a rear end of the safety lever near a sear of the handgun, wherein when the sear switch is in a first position the sear tab does not interfere with the action of the sear and when in a second position the sear tab causes the sear to tilt so that the sear is disengaged and cannot come in contact with a striker of the handgun to fire a bullet.

In an exemplary embodiment of the disclosure, the safety lever includes a safety lever tab that is configured to prevent motion of the safety lever when blocked by other elements of the handgun. Optionally, the handgun comprises a slide stopper that blocks motion of the slide when lifted up; and wherein the slide stopper includes a slide stopper tab that blocks the safety lever tab and prevents motion of the safety lever when the slide stopper is not lifted up to block motion of the slide. In an exemplary embodiment of the disclosure, the safety lever includes a magazine tab that is configured to prevent inserting a magazine when the safety lever is in the second position. Optionally, the safety lever includes a magazine tab that is configured to prevent motion of the safety lever when a magazine is loaded in the handgun.

In an exemplary embodiment of the disclosure, the handgun comprises a slide lock pin that prevents removal of the slide; and wherein the slide lock pin can only be removed when the safety lever is in the second position. Optionally, the safety lever comprises a toggle tab that limits positioning of the safety lever to specific positions. In an exemplary embodiment of the disclosure, the toggle tab is located behind the sear switch in a guiding groove. Optionally, the toggle tab serves as a resilient spring that clicks into the elected positions within the guiding groove. In an exemplary embodiment of the disclosure, the guiding groove includes two sockets separated by a bump to define the first position and the second position. Optionally, the safety lever is constructed as a solid unit.

There is further provided according to an exemplary embodiment of the disclosure, a method of disengaging a sear, comprising:

Receiving a handgun, with a safety lever located under a slide of the handgun and extending along a longitudinal axis within a body of the handgun, Moving a sear switch located external to the body of the handgun to a second position of one of at least two positions along the longitudinal axis of the handgun, wherein the sear switch is configured to move the safety lever with the sear switch;

Wherein the safety lever includes a sear tab at a rear end of the safety lever near a sear of the handgun; wherein in a first position the sear tab does not interfere with the action of the sear and in the second position the sear tab causes the sear to tilt so that the sear is disengaged and cannot come in contact with a striker of the handgun to fire a bullet.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein:

FIG. 1A is a schematic illustration of a first stage in dismantling a handgun, according to an exemplary embodiment of the disclosure;

FIG. 1B is a schematic illustration of a second stage in dismantling a handgun, according to an exemplary embodiment of the disclosure;

FIG. 2A is a schematic illustration of a safety lever in a first position, according to an exemplary embodiment of the disclosure;

FIG. 2B is a schematic illustration of a safety lever in a second position, according to an exemplary embodiment of the disclosure;

DETAILED DESCRIPTION

Figure 3B:
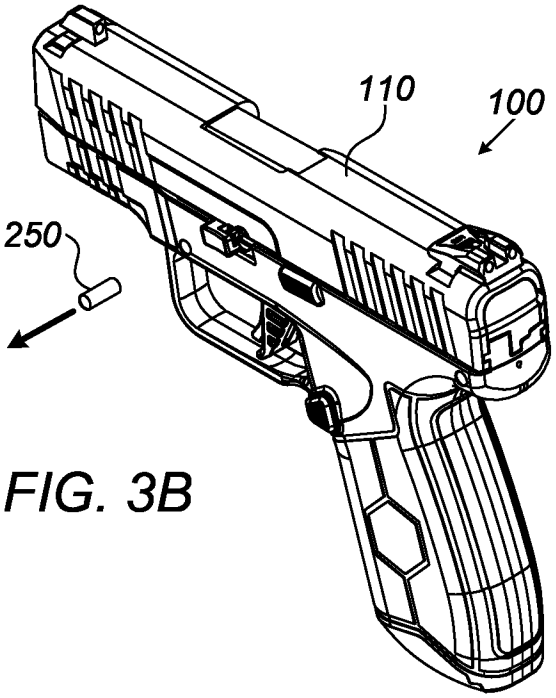
FIG. 3B is a side perspective view of a handgun with a removed slide lock pin, according to an exemplary embodiment of the disclosure.

FIG. 1A is a schematic illustration of a first stage in dismantling a handgun 100 and FIG. 1B is a schematic illustration of a second stage in dismantling a handgun 100, according to an exemplary embodiment of the disclosure. FIG. 2A is a schematic illustration of a safety lever 210 in a first position and FIG. 2B is a schematic illustration of safety lever 210 in a second position, according to an exemplary embodiment of the disclosure.

In an exemplary embodiment of the disclosure, handgun 100 is designed to disengage a sear 220 (FIG. 2A) to prevent accidental firing of a bullet when dismantling the handgun 100. Optionally, a user initially pulls a slide 110 of the handgun 100 backward toward the user, and may lock the slide 110 in place by lifting a slide stopper 120 to prevent the slide 110 from moving. In an exemplary embodiment of the disclosure, a slide stopper tab 125 initially prevents the safety lever 210 from moving. When the slide stopper 120 is lifted above a safety lever tab 215, safety lever 210 can then be moved forward from the first position within the handgun 100 to disengage the sear 220. Optionally, the user then is enabled to move a sear switch 130 forward along a longitudinal axis (X) of the handgun 100, thereby moving safety lever 210 forward (from the first position into the second position) and tilting sear 220 downward so that it cannot come in contact with striker 230 to initiate release of a shot.

In an exemplary embodiment of the disclosure, moving sear switch 130 forward disengages the sear 220 and reveals a slide lock pin 250 that prevents removal of slide 110. The slide 110 can only be removed when the slide lock pin 250 is removed from a slide lock pin socket 255 (FIG. 3C), after the sear 220 is disengaged, so that a bullet will not be accidentally released. Optionally, the sear switch 130 may have more than two positions to select other options.

In an exemplary embodiment of the disclosure, after moving sear switch 130 forward the slide stopper 120 can be lowered and the slide 110 can be returned forward. In this state safety lever 210 is locked in the second position and cannot be moved accidentally back to the first position so the handgun is locked in position to be safely dismantled. In this position the slide stopper tab 125 is behind the safety lever tab 215, in contrast to being initially in front of the safety lever tab 215.

Figure 3A:
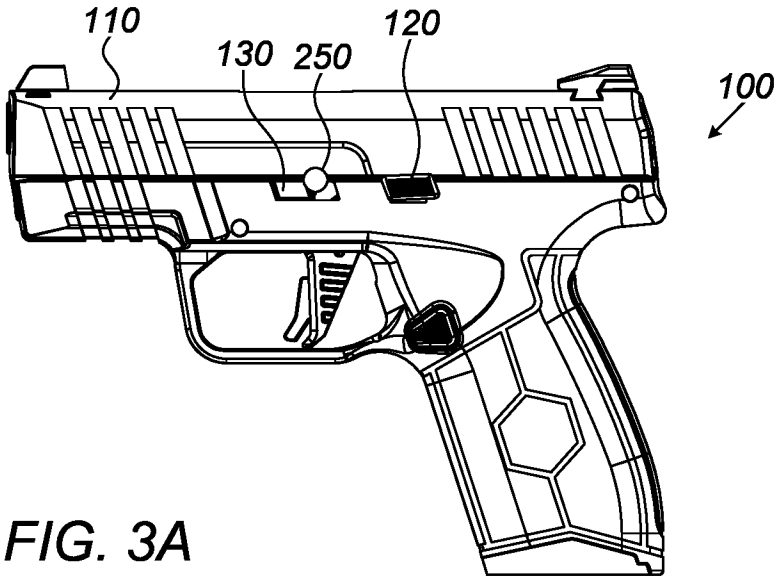
FIG. 3A is a side view of a handgun with a sear switch in a forward position to enable release of a slide lock pin to dismantle the slide of the handgun, according to an exemplary embodiment of the disclosure.
Figure 3C:
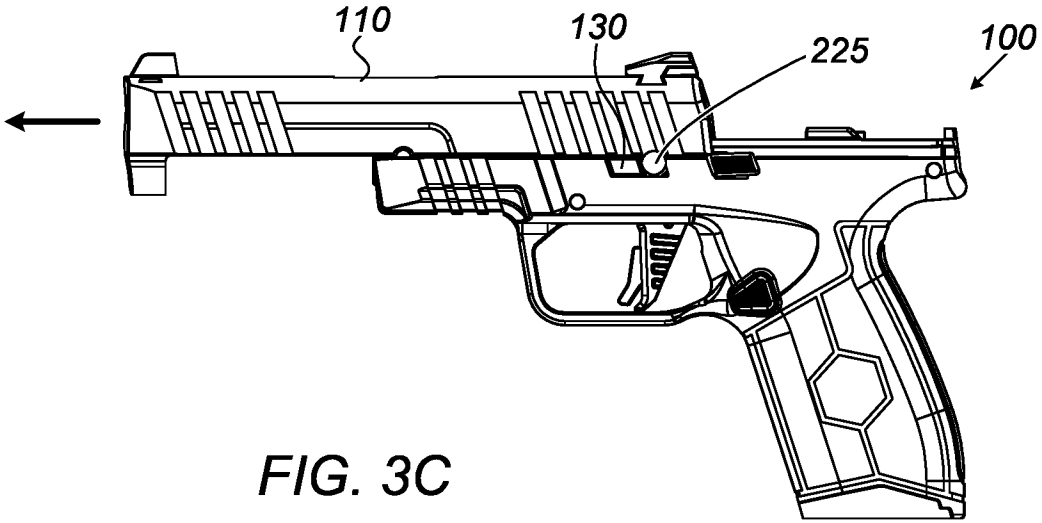
FIG. 3C is a side view of a handgun with a slide partially removed, according to an exemplary embodiment of the disclosure.
Figure 4A:
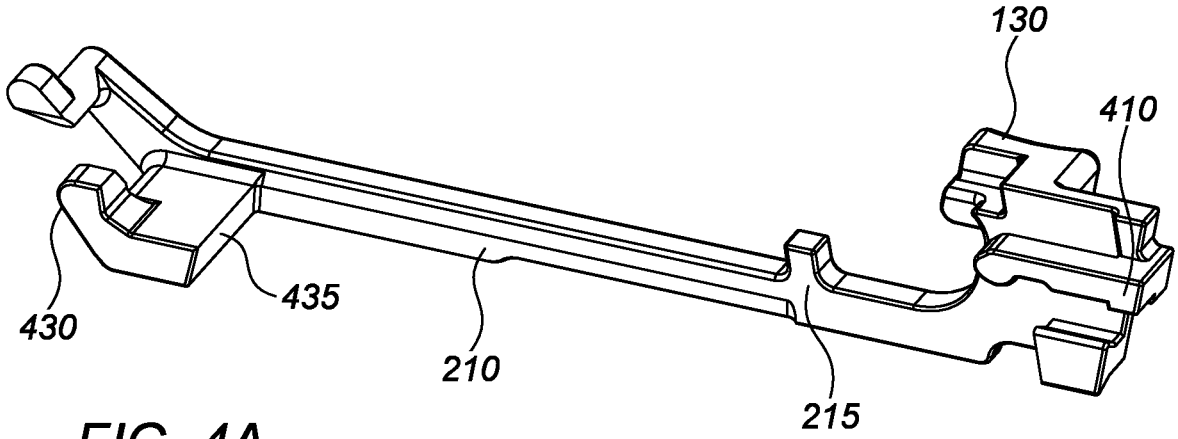
FIG. 4A is a schematic illustration of a perspective view of a safety lever, according to an exemplary embodiment of the disclosure.
Figure 4B:
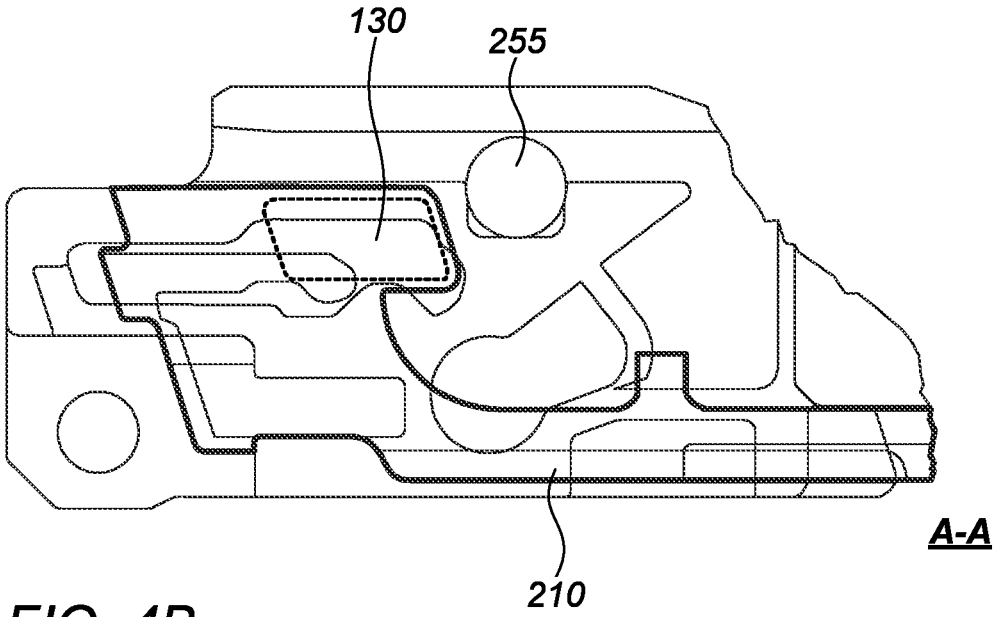
FIG. 4B is a transparent view of part of a handgun showing deployment of a fore end of a safety lever, according to an exemplary embodiment of the disclosure.

FIG. 3A is a side view of handgun 100 with sear switch 130 in a forward position enabling release of slide lock pin 250 to dismantle the slide 110 of the handgun 100. FIG. 3B is a side perspective view of handgun 100 with slide lock pin 250 removed, and FIG. 3*c* is a side view of handgun 100 with slide 110 partially removed, according to an exemplary embodiment of the disclosure;

FIG. 4A is a schematic illustration of a perspective view of safety lever 210 and FIG. 4B is a transparent view of part of a handgun showing deployment of a fore end of a safety lever 210, according to an exemplary embodiment of the disclosure.

As explained above the safety lever 210 includes a safety lever tab 215 to prevent movement of the safety lever 210 while slide stopper 120 is in position. Optionally, only when the slide 110 is moved to certain positions, for example shifted backward can the slide stopper 120 be lifted and then the safety lever 210 can be moved. In an exemplary embodiment of the disclosure, safety lever 210 further includes a sear tab 430 that is configured to push sear 220 so that it will rotate downward, when safety lever 210 is moved forward. Optionally, safety lever 210 further includes a toggle tab 410 behind sear switch 130, for example back to back with sear switch 130 as part of safety lever 210.

Figure 4C:
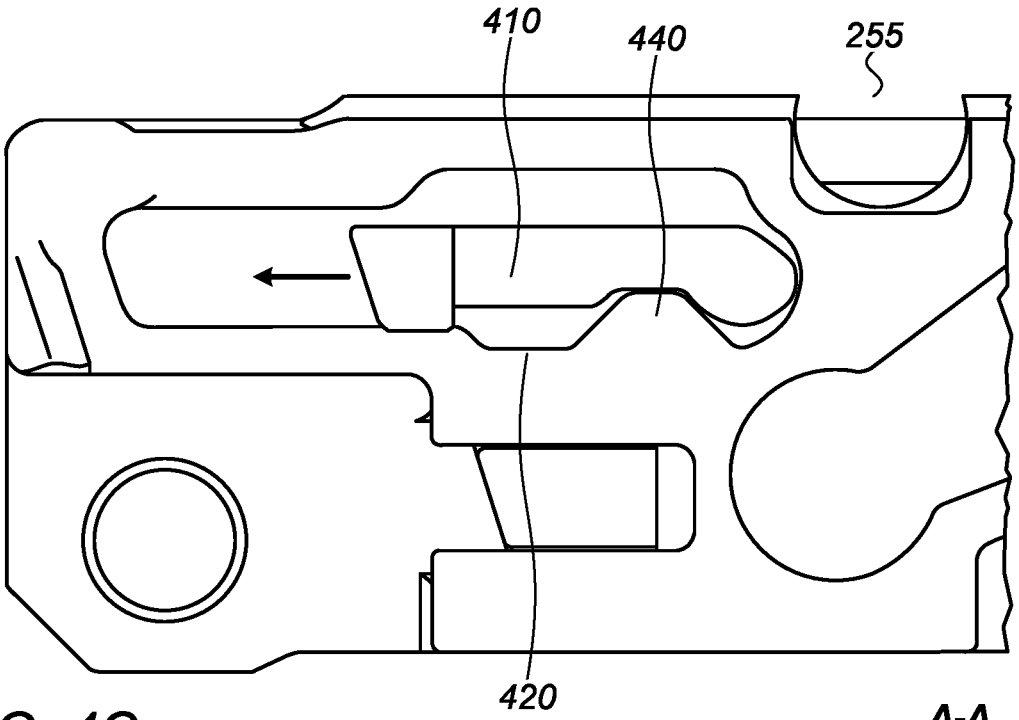
FIG. 4C is a schematic illustration of a cross sectional view AA of part of a handgun with the safety lever deployed in a first position, according to an exemplary embodiment of the disclosure.
Figure 4D:
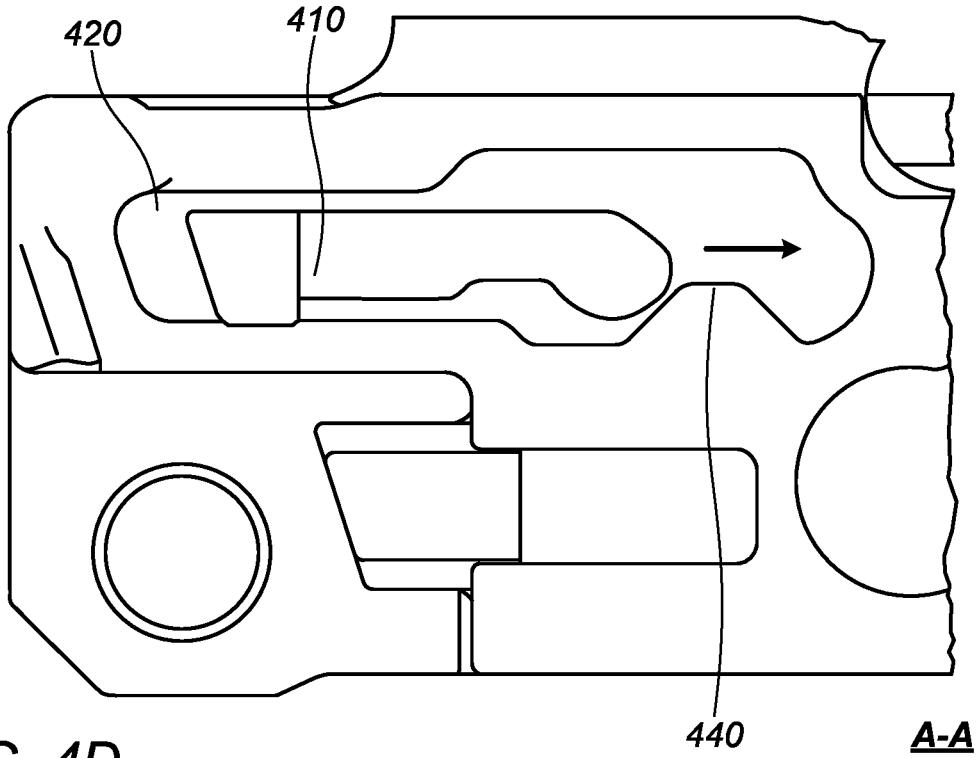
FIG. 4D is a schematic illustration of a cross sectional view AA of part of a handgun with the safety lever deployed in a second position, according to an exemplary embodiment of the disclosure.

In an exemplary embodiment of the disclosure, toggle tab 410 fits into a guiding groove 420 (FIGS. 4C and 4D). The toggle tab 410 serves as a resilient spring, which can slide between the first stage position as shown in FIG. 4C to the second stage position as shown in FIG. 4D. FIG. 4C is a schematic illustration of a cross sectional view AA of part of handgun 100 with safety lever 210 deployed in the first position and FIG. 4D is a schematic illustration of a cross sectional view AA of part of handgun 100 with the safety lever 210 deployed in the second position.

In an exemplary embodiment of the disclosure, the toggle tab 410 clicks into at least the two positions and requires that the user apply a force to toggle it from position to position, for example by being lifted over bump 440. In an exemplary embodiment of the disclosure, after lifting slide stopper 120 the user can move sear switch 130 forward along the longitudinal axis of the firearm 100 to disengage the sear 220.

Figure 5A:
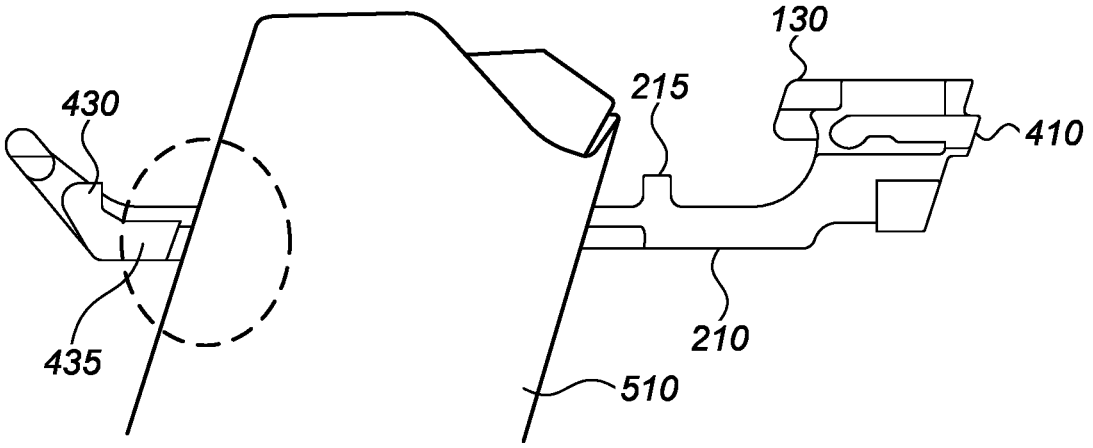
FIG. 5A is a schematic illustration of a side view of a safety lever interfacing a magazine, according to an exemplary embodiment of the disclosure.

FIG. 5A is a schematic illustration of a side view of safety lever 210 interfacing a magazine 510; according to an exemplary embodiment of the disclosure. Optionally, safety lever 210 includes a magazine tab 435 that abuts the magazine 510 (in the first position) and prevents movement of the safety lever 210 when the magazine 510 is loaded. Therefore the magazine must be removed before the handgun 100 can be dismantled.

Figure 5B:
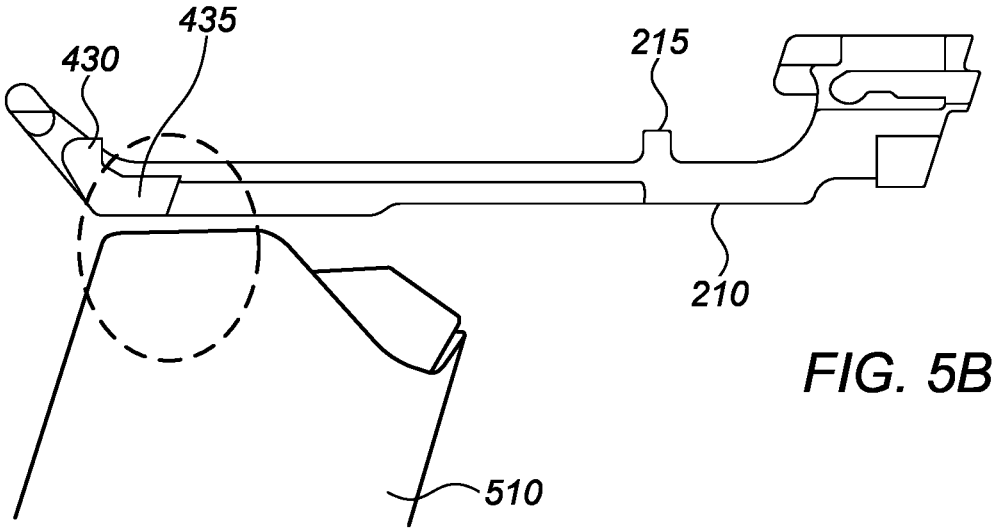
FIG. 5B is a schematic illustration of a side view of a magazine below a safety lever, according to an exemplary embodiment of the disclosure.
Figure 5C:
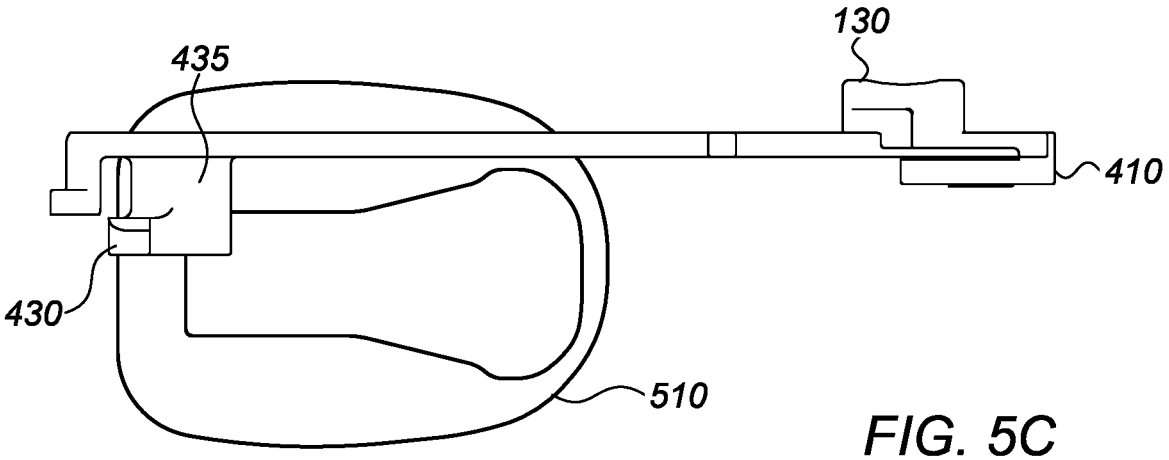
FIG. 5C is a schematic illustration of a top view of a magazine below a safety lever, according to an exemplary embodiment of the disclosure.

FIG. 5B is a schematic illustration of a side view of magazine 510 below safety lever 210 and FIG. 5C is a schematic illustration of a top view of magazine 510 below safety lever 210; according to an exemplary embodiment of the disclosure. Optionally, when safety lever 210 is moved forward to disengage the sear 220 (in the second position), the magazine lever 435 prevents insertion of the magazine 510. Therefore bullets cannot be loaded when the handgun is dismantled and the sear 220 is disengaged.

In an exemplary embodiment of the disclosure, safety lever 210 is constructed as a solid unit with all the above described tabs (e.g. 130, 215, 410, 430 and 435) as parts of the solid unit. Alternatively, at least some of the elements of safety lever 210 may be separate elements that are coupled to a central elongated element.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure.

It will be appreciated by persons skilled in the art that the present invention is not limited to what has been particularly shown and described hereinabove. Rather the scope of the present invention is defined only by the claims, which follow.

We claim:

1. A handgun, comprising:

a safety lever for disengaging a sear, the safety lever located under a slide of the handgun and extending along a longitudinal axis within a body of the handgun;

wherein the safety lever comprises:

(a) a sear switch located external to the body of the handgun, and is configured to be positioned by a user in one of at least two positions along the longitudinal axis of the handgun and configured to move the safety lever with the sear switch to an elected position;

(b) a sear tab at a rear end of the safety lever near a sear of the handgun, wherein when the sear switch is in a first position the sear tab does not interfere with an action of the sear and when in a second position the sear tab causes the sear to tilt so that the sear is disengaged and cannot come in contact with a striker of the handgun to fire a bullet;

wherein the safety lever includes a safety lever tab that is configured to prevent motion of the safety lever when blocked by other elements of the handgun; and wherein the handgun comprises a slide stopper that blocks motion of the slide when lifted up; and wherein the slide stopper includes a slide stopper tab that blocks the safety lever tab and prevents motion of the safety lever when the slide stopper is not lifted up to block motion of the slide.

2. The handgun of claim 1, wherein the safety lever includes a magazine tab that is configured to prevent inserting a magazine when the safety lever is in the second position.

3. The handgun of claim 1, wherein the safety lever includes a magazine tab that is configured to prevent motion of the safety lever when a magazine is loaded in the handgun.

4. The handgun of claim 1, wherein the handgun comprises a slide lock pin that prevents removal of the slide; and wherein the slide lock pin can only be removed when the safety lever is in the second position.

5. The handgun of claim 1, wherein the safety lever comprises a toggle tab that limits positioning of the safety lever to specific positions.

6. The handgun of claim 5, wherein the toggle tab is located behind the sear switch in a guiding groove.

7. The handgun of claim 1, wherein the safety lever is constructed as a solid unit.

8. A handgun, comprising:

a safety lever for disengaging a sear, the safety lever located under a slide of the handgun and extending along a longitudinal axis within a body of the handgun;

wherein the safety lever comprises:

(a) a sear switch located external to the body of the handgun, and is configured to be positioned by a user in one of at least two positions along the longitudinal axis of the handgun and configured to move the safety lever with the sear switch to an elected position;

(b) a sear tab at a rear end of the safety lever near a sear of the handgun, wherein when the sear switch is in a first position the sear tab does not interfere with an action of the sear and when in a second position the sear tab causes the sear to tilt so that the sear is disengaged and cannot come in contact with a striker of the handgun to fire a bullet;

wherein the safety lever comprises a toggle tab that limits positioning of the safety lever to specific positions;

wherein the toggle tab is located behind the sear switch in a guiding groove; and wherein the toggle tab serves as a resilient spring that clicks into elected positions within the guiding groove.

9. The handgun of claim 8, wherein the guiding groove includes two sockets separated by a bump to define the first position and the second position.

10. A method of disengaging a sear, comprising:

receiving a handgun, with a safety lever located under a slide of the handgun and extending along a longitudinal axis within a body of the handgun, moving a sear switch located external to the body of the handgun to a second position of one of at least two positions along the longitudinal axis of the handgun, wherein the sear switch is configured to move the safety lever with the sear switch;

wherein the safety lever includes a sear tab at a rear end of the safety lever near a sear of the handgun; wherein in a first position the sear tab does not interfere with an action of the sear and in the second position the sear tab causes the sear to tilt so that the sear is disengaged and cannot come in contact with a striker of the handgun to fire a bullet;

wherein the safety lever includes a tab that is configured to prevent motion of the safety lever when grasped by other elements of the handgun; and wherein the handgun comprises a slide stopper that blocks motion of the slide when lifted up; and wherein the slide stopper includes a slide stopper tab that blocks the safety lever tab and prevents motion of the safety lever when the slide stopper is not lifted up to block motion of the slide.

11. The method of claim 10, wherein the safety lever includes a magazine tab that is configured to prevent inserting a magazine when the safety lever is in the second position.

12. The method of claim 10, wherein the safety lever includes a magazine tab that is configured to prevent motion of the safety lever when a magazine is loaded in the handgun.

13. The method of claim 10, wherein the handgun comprises a slide lock pin that prevents removal of the slide; and wherein the slide lock pin can only be removed when the safety lever is in the second position.

14. The method of claim 10, wherein the safety lever comprises a toggle tab that limits positioning of the safety lever to specific positions.

15. The method of claim 14, wherein the toggle tab is located behind the sear switch in a guiding groove.

16. The method of claim 15, wherein the toggle tab serves as a resilient spring that clicks into elected positions within the guiding groove.

* * * * *